United States Patent [19]

Pocock et al.

[11] 4,249,667

[45] Feb. 10, 1981

[54] PLASTIC CONTAINER WITH A GENERALLY HEMISPHERICAL BOTTOM WALL HAVING HOLLOW LEGS PROJECTING THEREFROM

[75] Inventors: John F. E. Pocock, Neu Isenburg, Fed. Rep. of Germany; Suppayan M. Krishnakumar; Gautam K. Mahajan, both of Nashua, N.H.; Richard E. Clark, Merrimack, N.H.

[73] Assignee: The Continental Group, Inc., New York, N.Y.

[21] Appl. No.: 88,238

[22] Filed: Oct. 25, 1979

[51] Int. Cl.[3] ..... B65D 1/02

[52] U.S. Cl. ..... 215/1 C; 220/70

[58] Field of Search ..... 215/1 C; 220/70

[56] References Cited

U.S. PATENT DOCUMENTS

| | | | |
|---|---|---|---|
| 3,598,270 | 8/1971 | Adomaitis | 215/1 C |
| 3,727,783 | 4/1973 | Carmichael | 215/1 C |
| 3,871,541 | 3/1975 | Adomaitis | 215/1 C |

*Primary Examiner*—Donald F. Norton

*Attorney, Agent, or Firm*—Charles E. Brown

[57] ABSTRACT

This disclosure relates to improvements in the cross section of a bottom end of a plastic bottle suitable for packaging liquids under internal pressures. The bottom end is primarily one which includes a generally hemispherical bottom wall having projecting therefrom in circumferentially spaced relation hollow legs terminating in supporting feet. The bottom end is stiffened against creep of the plastic material over a period of time under the influence of the internal pressure by changing the configuration of the bottom wall from that of a hemisphere to one which includes a configuration of straight line sections and curved line sections when viewed in radial cross section along the axis of the bottle.

10 Claims, 9 Drawing Figures

FIG.1 PRIOR ART
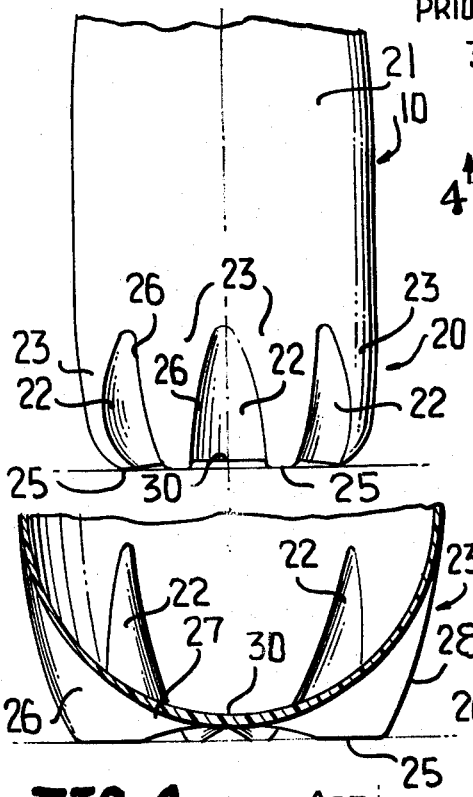
FIG.2 PRIOR ART
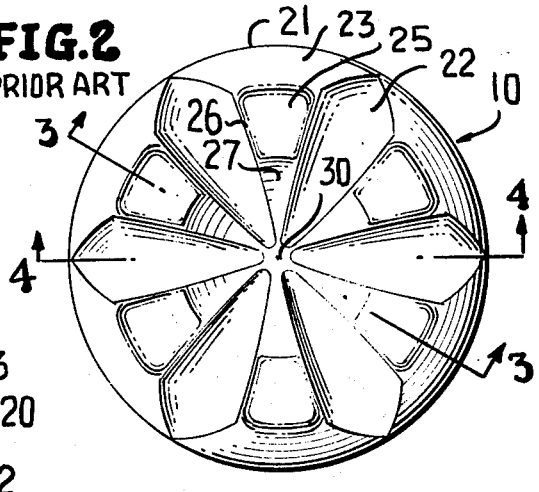
FIG.3 PRIOR ART
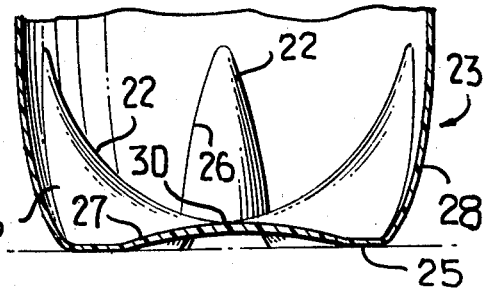
FIG.4 PRIOR ART
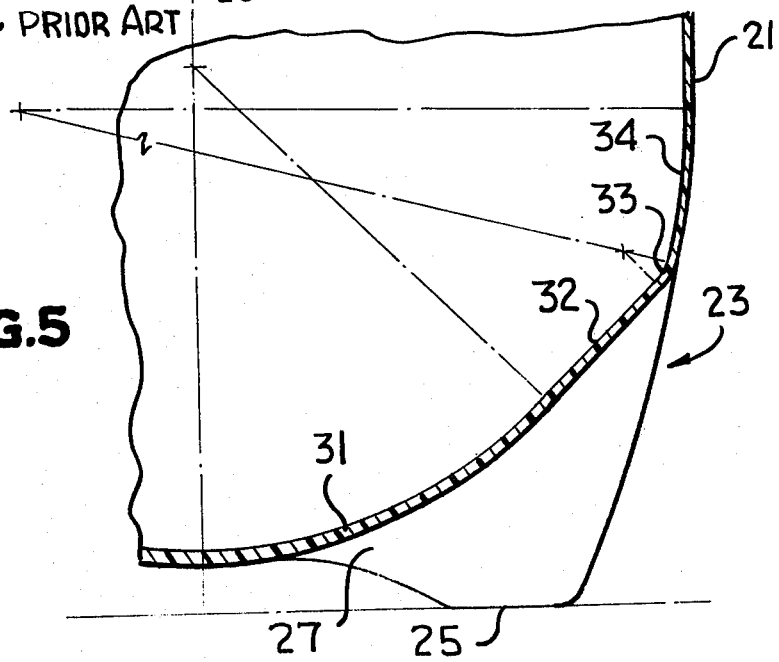
FIG.5

PLASTIC CONTAINER WITH A GENERALLY HEMISPHERICAL BOTTOM WALL HAVING HOLLOW LEGS PROJECTING THEREFROM

This invention relates in general to new and useful improvements in hollow plastic containers, and more particularly to a plastic bottle which is blow molded and which has a bottom configuration sufficient to withstand high internal pressures such as those encountered in the packaging of carbonated beverages and the like.

Reference is first made to the U.S. Pat. to Adomaitis et al, No. 3,598,270, granted Aug. 10, 1971, which discloses a plastic bottle having a bottom configuration of the type to which this invention relates. Such a bottle has a generally hemispherical outwardly convex bottom wall which is interrupted by a plurality of circumferentially spaced hollow legs extending downwardly therefrom and terminating in feet. The legs are spaced about the bottom wall with portions of the bottom wall extending between adjacent legs and the bottom wall portions all terminating in a hollow polar portion.

Bottles of the above-described type have been commercially produced, and while they are fully acceptable from the standpoint of strength and resistance to bursting under internal pressures even when dropped, it has been found that the plastic material has a tendency to creep, particularly in the bottom structure, such that the volume of the bottle increases and the fill line of the liquid therein lowers to the point where the ultimate customer is led to believe that the bottle was not properly initially filled.

The creep is primarily in the bottom wall between the legs. Basically, the hemispherical configuration of the bottom wall, particularly adjacent its juncture with the bottle body, tends to flatten out from an arcuate cross section to a substantially straight line cross section with the point of intersection between the bottom cross section and the bottle wall being lowered.

In accordance with this invention, it is proposed to modify the true hemispherical configuration of the bottom wall to one which includes one or more frustoconical portions which in cross section have the appearance of a straight line. It has been found that by making this minor modification in the bottom configuration and otherwise generally retaining the bottom configuration, the undesired creep under internal pressure is greatly reduced to one which is not readily observable by a drop in the liquid level.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is a fragmentary side elevational view of the bottom portion of a prior art bottle.

FIG. 2 is a bottom plan view of the bottle of FIG. 1.

FIG. 3 is a fragmentary vertical sectional view taken generally along the line 3—3 of FIG. 2, and shows the configuration of the bottle in the leg area.

FIG. 4 is a fragmentary vertical sectional view taken generally along the line 4—4 of FIG. 2, and shows the cross section of the hemispherical bottom wall.

FIG. 5 is a vertical sectional view similar to FIG. 4, and shows a modified form of bottom wall.

Figure 6:
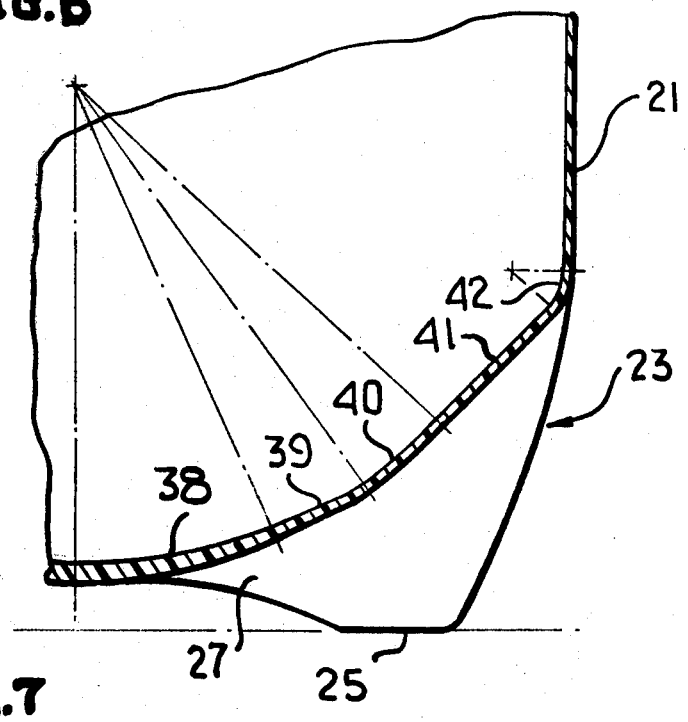
FIG. 6 is a sectional view also similar to FIG. 4, and shows yet another bottom wall cross section.

Referring first to the prior art showings of FIGS. 1–4, it will be seen that there is illustrated a bottle formed in accordance with the disclosure of the U.S. Pat. to Adomaitis et al, No. 3,598,270, granted Aug. 10, 1971, the bottle being generally identified by the numeral 10. The bottle 10 may have any type of neck finish (not shown) and has a bottom end generally indicated by the numeral 20. The bottle 10 also has a side wall or body 21 into which the bottom end 20 smoothly blends.

The bottom end 20 is basically of a hemispherical outline having projecting therefrom a plurality of circumferentially spaced hollow legs 23 with the bottom wall actually being in the form of spaced-apart wall portions 22 disposed between adjacent legs 23.

It will be seen from the sectional view of FIGS. 3 and 4 that the wall portions 22 and the legs 23 are generally of the same wall thickness with only moderate thickness variations. Preferably, the bottle 10 is blow molded from a tubular parison. The variations in wall thickness which exist are in accordance with the degree of material distention involved in blowing the parison or preform to the general configuration in a blow mold (not shown).

As is clearly shown in FIG. 4, the wall portions 22 together define a semicircle 24 with all of the portions 22 extending out from a lower polar wall portion 30. The leg portions 23 extend downwardly axially beyond the polar portion 30 to generally flat wall portions in the form of feet 25 generally lying in a common lowermost plane on which the bottle will thus rest in an upright position.

In the illustrated embodiment of the invention there are six legs 23 alternating with six hemispherical wall portions 22. However, the number of legs and thus feet may be varied as is required of the particular bottle, although six has been found to be the most promising number.

The sides of the feet 25 are defined along generally radial lines by leg side walls 26 which extend upwardly from the feet 25 and converge with the hemispherical wall portions 22. In addition, wall portions 27 extend upwardly and inwardly from the feet 25 and also blend into the hemispherical wall portions 22, as is best shown in FIG. 3.

Finally, outer leg wall portions 28 extend upwardly and outwardly from the feet 25 to blend into the side wall 21. It will be readily apparent from FIG. 4 that the walls 28 of the legs 23 almost form a cylindrical extension of the side wall 21. It will also be apparent from FIGS. 3 and 4 that when the upper parts of the hemispherical bottom wall portions 22 begin to stretch generally radially outwardly and downwardly under sustained pressure, they also begin generally to form cylindrical wall portions with the intersection between each wall portion 22 moving axially downwardly therewith being a like general extension of the side wall 21.

This creep and distortion of the bottom 20 in no way detracts from the structural strength of the bottom. It does, however, materially increase the volume of the bottom section 20 to the extent that the liquid level within the bottle undesirably drops to the extent that it is readily noticeable.

In accordance with this invention, it is proposed to modify the configuration of the bottom wall so that the cross section of each bottom wall portion 22 will change from its constant radius configuration of FIG. 4 to another configuration wherein the affect of creeping in the bottom structure is held to a minimum.

Reference is first made to FIG. 5, wherein it is first proposed to modify the cross section of each wall portion 22 to have a lower part which is in the form of a constant radius configuration having its center along the longitudinal axis of the bottle. This lower portion is identified by the numeral 31 and the cross section is that of a part-spherical bottom wall segment.

In section, the bottom wall portion upwardly from the curved line portion 31 includes a straight line portion 32 which extends tangentially from the adjacent part of the curved line section 31. The straight line cross sectional portion 32 is the cross section of a frustoconical intermediate portion.

The bottom wall next includes an annular segment which is defined by a short radius curved line 33 in cross section. The radius of the curved line 33 is on the order of one-tenth the radius of the curved line 31.

The bottom structure finally includes an uppermost annular segment which smoothly blends into the side wall 21. The upper annular segment in cross section is in the form of a curved line 34 having a large radius as compared to the radius of the curved line 31 with the radius of the curved line 34 being on the order of three times the radius of the curved line 31.

It has been found that when the bottom wall portions have been modified from portions of a hemisphere to the above-described cross section, the tendency of the bottom wall to creep to a more cylindrical configuration adjacant the side wall or body 21 is greatly restricted and the increase in volume of the bottom end 20 is greatly reduced, the reduction being one wherein the increase in volume is not noticeable by way of a liquid level drop.

Figure 9:
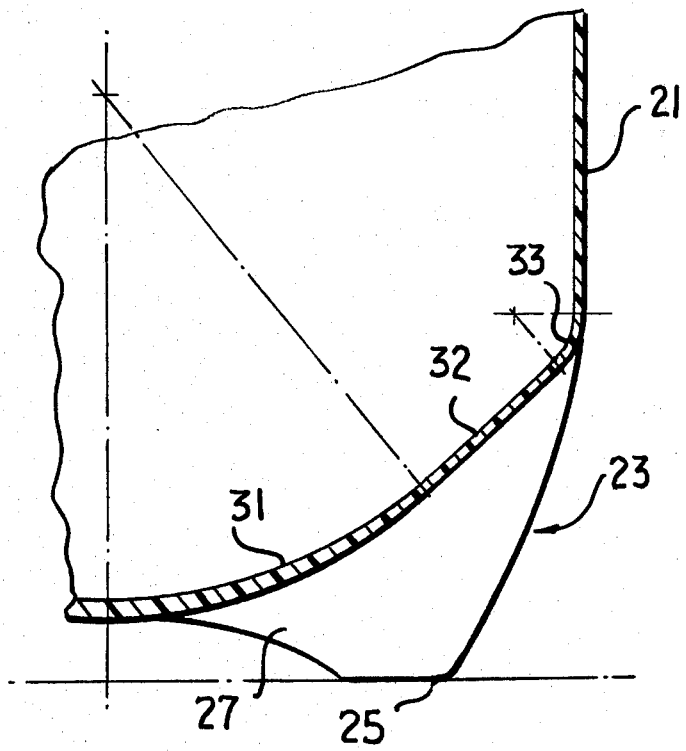
FIG. 9 is a fragmentary vertical sectional view similar to FIG. 5, and shows the modified bottom wall configuration in use with a foreshortened bottom structure.

Referring now to FIG. 9 in particular, it will be seen that, if desired, the extent of the straight line section 32 may be increased in an upwardly directed direction and the side wall or body 21 may be extended further downwardly so that the curved line 34 blends directly into the side wall 21, thereby providing for an elimination of the annular upper segment defined in cross section by the curved line 34.

Although in the illustrated embodiment of the invention the arcuate extent of the curved line portion 31 is on the order of 45°, it is to be understood that variations may be made in the extent of the various portions of the cross section of the bottom wall portions without departing from the spirit of the invention.

Reference is now made to the bottom end cross section of FIG. 6 wherein it will be seen that the annular extent in cross section of a lowermost spherical segment, defined in cross section by a curved line 38, is much less than that of the hemispherical segment of FIG. 5 defined by the curved line 31. A frustoconical bottom segment defined in cross section by a straight line 39 is next joined to the lowermost spherical segment defined by the curved line 38.

Above the frustoconical bottom segment defined by the straight line 39 is an annular hemispherical segment defined by a curved line 40. While this segment is preferably in the form of a hemispherical segment having the same radius and center as that of the curved line 38, it is to be understood that from a practical standpoint the radius and center of the curved line 40 could be varied.

Next, above the part-spherical segment defined in cross section by the curved line 40 is a frustoconical segment defined in cross section by a straight line 41. The straight line 41 extends tangentially to the curved line 40 as does the straight line 39 with respect to the curved lines 38 and 40.

The bottom end terminates in an upper annular segment defined in cross section by a small radius curved line 42 which blends into the side wall 21. The radius of the curved line 42 is much reduced from that of the curved lines 38 and 40 and being on the order of one-tenth.

Figure 7:
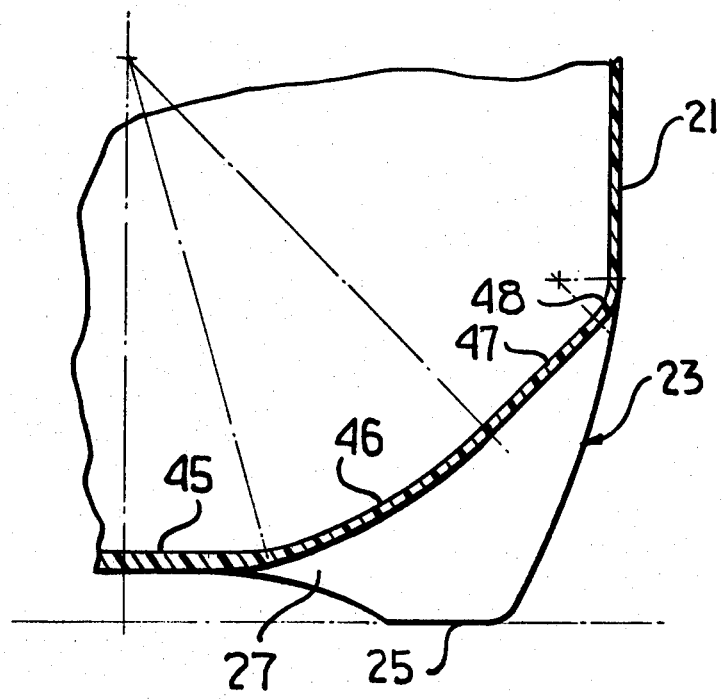
FIG. 7 is another view similar to FIG. 4, and shows still another bottom wall cross section.

In FIG. 7 a different modification of the cross section of the generally hemispherical bottom wall is shown. First of all, the extreme bottom or polar part of the bottom wall is planar and is defined by a straight line 45. Next, adjacent the planar bottom part is a spherical segment defined by a curved line 46, the spherical segment being annular and the curved line 46 being a radius corresponding to the customary radius of the bottom when initially formed as a hemisphere with the center of the curved line 46 being along the axis of the bottle.

The generally hemispherical bottom wall is next in the form of a frustoconical segment defined in cross section by a straight line 47. The straight line 47 extends tangentially from the curved line 46. The frustoconical segment defined in cross section by the straight line 47 forms the upper part of the bottom wall and is joined to the side wall or body 21 of the bottle by an annular segment defined in cross section by a small radius curved line 48, the radius of the curved line 48 being on the order of one-tenth of the radius of the curved line 46.

Figure 8:
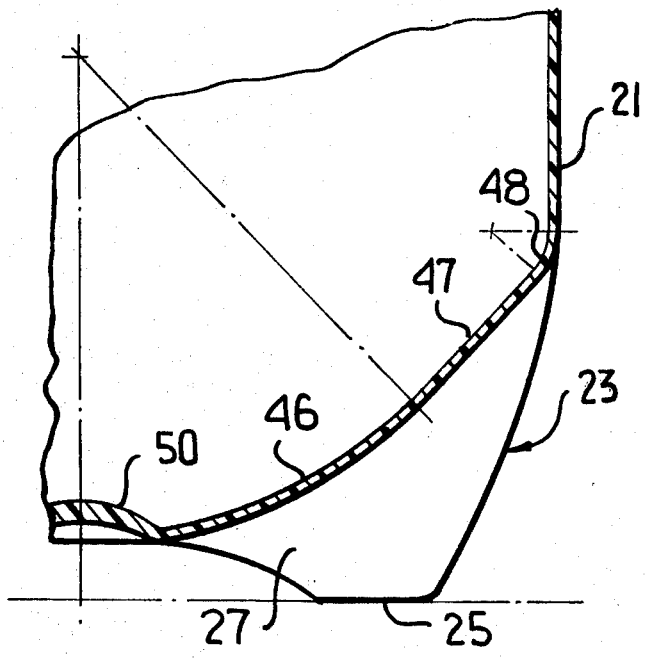
FIG. 8 is another view similar to FIG. 4, and shows still another bottom wall cross section.

Finally, reference is made to FIG. 8 which discloses the generally hemispherical bottom wall as having a polar part which is upwardly convexly curved and is defined in cross section by a curved line 50. It is to be understood that while in the illustrated form of FIG. 8 the remainder of the bottom wall cross section corresponding to that of FIG. 7, the upwardly convexed bottom segment of the bottom wall may be incorporated in the bottom wall structures of FIGS. 5, 6, 7 and 9.

All of the bottom wall cross sections specifically illustrated in FIGS. 5–9 produce a material reduction in the creep of the plastic material of the bottom end under internal pressures, thereby providing for a much more rigid bottom construction and the elimination of the present undesired drop in the liquid level within the bottle.

It is also apparent that by selecting the arrangement of straight and curved line cross sections the height of the bottom end may be materially reduced to substantially that of the legs 23 so that the overall height of the bottom end may be one which is readily adaptable to the known bottle configurations of certain leading suppliers of carbonated beverages.

Although only several preferred embodiments of the invention have been specifically illustrated and described herein, it is to be understood that the bottom cross section may be further varied generally in accordance with the teachings of this invention without departing from the spirit and scope of the invention as defined by the appended claims.

We claim:

1. In a blow molded plastic container of the type comprising a tubular body terminating in a generally hemispherical outwardly convex bottom wall, said bottom wall being interrupted by a plurality of circumferentially spaced hollow legs with portions of said bottom wall disposed therebetween and terminating in a lower polar portion, said hollow legs terminating in lowermost supporting feet the improvement comprising said bottom wall in axial half cross-section between an adjacent pair of said legs being in part of a constant curvature and in part other than of a constant curvature and including a constant curvature curved line portion and an intermediate straight line portion wherein said bottom has a frustoconical segment.

2. The container of claim 1 wherein below said frustoconical bottom segment there is disposed next adjacent a spherical bottom segment including said lower polar portion and said straight line extends tangential from a curved line axial section of said spherical bottom segment, said spherical bottom segment being defined by said curved line portion.

3. The container of claim 1 wherein said axial half cross-section said bottom wall includes a second straight line portion spaced below said first mentioned intermediate straight line portion with said curved line portion being between said two straight line portions.

4. The container of claim 3 wherein said curved line portion is a section of a part spherical segment with said part spherical segment being disposed between said frustoconical segment of which said first mentioned intermediate straight line is a section and a lower frustoconical segment of which said second straight line is a section.

5. The container of claim 4 wherein said bottom wall lower polar portion is in the form of a lowermost part spherical segment disposed below said lower frustoconical segment.

6. The container of claim 3 wherein said curved line portion is a section of a part spherical segment with said part spherical segment being disposed between said frustoconical segment of which said first mentioned intermediate straight line is a section and a lower planar segment forming said lower polar portion.

7. The container of claim 1 wherein said bottom wall above said frustoconical segment includes an annular segment defined in cross section by a curved line of a radius materially less than the radius of said constant curvature curved line portion.

8. The container of claim 7 wherein said bottom wall above said annular segment includes an upper annular segment which blends into said body, said upper annular segment being defined in section by a curved line of a radius materially greater than the radius of said constant curvature curved line portion.

9. The container of claim 7 wherein said annular segment blends into said body.

10. The container of claim 1 wherein said lower polar portion is concaved and projects into the interior of said container.

* * * * *